US007957659B2

(12) United States Patent
Nada et al.

(10) Patent No.: US 7,957,659 B2
(45) Date of Patent: Jun. 7, 2011

(54) IMAGE FORMING APPARATUS FOR MARGINLESS PRINTING

(75) Inventors: Takao Nada, Numazu (JP); Takuma Abe, Mishima (JP); Kiyoharu Yoshioka, Mishima (JP); Tomonori Shida, Boise, ID (US); Keisuke Mitsuhashi, Suntou-gun (JP); Michio Uchida, Susono (JP); Noritomo Yamaguchi, Suntou-gun (JP); Tomoya Tateishi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 12/275,514

(22) Filed: Nov. 21, 2008

(65) Prior Publication Data

US 2009/0136247 A1 May 28, 2009

(30) Foreign Application Priority Data

Nov. 27, 2007 (JP) ..... 2007-305632

(51) Int. Cl.
*G03G 15/16* (2006.01)

(52) U.S. Cl. ..... 399/66; 399/45; 399/60; 399/82

(58) Field of Classification Search ..... 399/45, 399/60, 82, 66

See application file for complete search history.

(56) References Cited

U.S. PATENT DOCUMENTS

| | | | | |
|---|---|---|---|---|
| 6,834,178 | B2 | 12/2004 | Takeda | |
| 2003/0202808 | A1 * | 10/2003 | Katamoto | 399/45 |
| 2006/0033795 | A1 * | 2/2006 | Yokoi | 347/104 |
| 2006/0216047 | A1 | 9/2006 | Yamamoto et al. | |
| 2007/0196147 | A1 * | 8/2007 | Nada et al. | 399/358 |
| 2007/0201922 | A1 | 8/2007 | Takahashi | |
| 2009/0202279 | A1 * | 8/2009 | Saito et al. | 399/297 |
| 2009/0269095 | A1 * | 10/2009 | Mitsuhashi et al. | 399/66 |
| 2009/0324278 | A1 * | 12/2009 | Tomura et al. | 399/101 |

FOREIGN PATENT DOCUMENTS

| | | | |
|---|---|---|---|
| JP | 2004-333935 | A | 11/2004 |
| JP | 2004333935 | A * | 11/2004 |
| JP | 2006-162642 | A | 6/2006 |
| JP | 3848147 | B2 | 9/2006 |
| JP | 2007-226044 | A | 9/2007 |

OTHER PUBLICATIONS

U.S. Appl. No. 12/364,757, filed Feb. 3, 2009, Yoshiro et al.

* cited by examiner

*Primary Examiner* — David P Porta
*Assistant Examiner* — Casey Bryant
(74) *Attorney, Agent, or Firm* — Fitzpatrick, Cella, Harper & Scinto

(57) ABSTRACT

Provided is an image forming apparatus in which the image forming apparatus has a marginless mode in which the toner image is formed on said image bearing member in an area that covers the recording material and an area outside the recording material, and the toner image is transferred to extend beyond an edge of the recording material carried by said recording material carrying member, the image forming apparatus further including: a detecting device which detects the toner image that extends beyond the edge of the recording material and is transferred to said recording material carrying member in the marginless mode; and a control device which uses a detection result provided by said detecting device to control where said exposure device forms a latent image on said image bearing member.

7 Claims, 7 Drawing Sheets

IMAGE FORMING APPARATUS FOR MARGINLESS PRINTING

BACKGROUND OF THE INVENTION

1. Field of the Invention

The present invention relates to an image forming apparatus in which a toner image is formed on an image bearing member where a latent image has been formed by an exposure device and the toner image is transferred to a recording material. More particularly, the present invention relates to an apparatus that forms a marginless image on a recording material.

2. Description of the Related Art

An apparatus having a sensor that detects edges of a recording material before a point where an image is transferred to the recording material is a known structure to form an image at a satisfactorily precise position on a recording material. For example, Japanese Patent No. 3,848,147 discloses a structure for detecting an edge of a recording material in a recording material conveying direction and an edge of the recording material in a direction orthogonal to the recording material conveying direction with an image sensor being placed at a point upstream of the transfer point along a recording material conveying path. An image forming apparatus disclosed in this related art example attempts to improve the precision of the image formation position by detecting edges of a recording material before the transfer point and adjusting when to form an image based on this detection information.

However, the above-mentioned image forming apparatus adjusts a timing of forming an image based on information about the recording material position detected before the transfer point. The precision of the image formation position of the image forming apparatus disclosed in the above-mentioned related art example can be low when the curling, rippling, or the like of a recording material produces fluctuating results in recording material edge detection, or when there is an error in distance from a point where the sensor detects the edges to the transfer point or an error in recording material conveying speed.

SUMMARY OF THE INVENTION

The present invention has been made in view of the above, and an object of the present invention is therefore to provide an image forming apparatus improved in precision of an image formation position with respect to a recording material.

Another object of the present invention is to provide an image forming apparatus, comprising: an image bearing member; an exposure device which exposes said image bearing member to light to form a latent image on said image bearing member; and a recording material carrying member which carries and conveys a recording material, wherein the latent image on said image bearing member is developed with a toner and a toner image on said image bearing member is transferred to the recording material carried by said recording material carrying member, and wherein the image forming apparatus has a marginless mode in which the toner image is formed on said image bearing member in an area that covers the recording material and an area outside the recording material, and the toner image is transferred to extend beyond an edge of the recording material carried by said recording material carrying member, the image forming apparatus further comprising: a detecting device which detects the toner image that extends beyond the edge of the recording material and is transferred to said recording material carrying member in the marginless mode; and a control device which uses a detection result provided by said detecting device to control where said exposure device forms a latent image on said image bearing member.

Other objects of the present invention become apparent from the following description.

Further features of the present invention become apparent from the following description of exemplary embodiments with reference to the attached drawings.

DESCRIPTION OF THE EMBODIMENTS

A detailed description is given below with reference to the drawings on exemplary embodiments of the present invention. However, the dimensions, materials, shapes, and relative placement of components described in the following embodiments are to be changed to suit the structure and various conditions of an apparatus to which the present invention is applied. Therefore, those are not to limit the scope of the present invention unless otherwise stated.

First Embodiment

Figure 1:
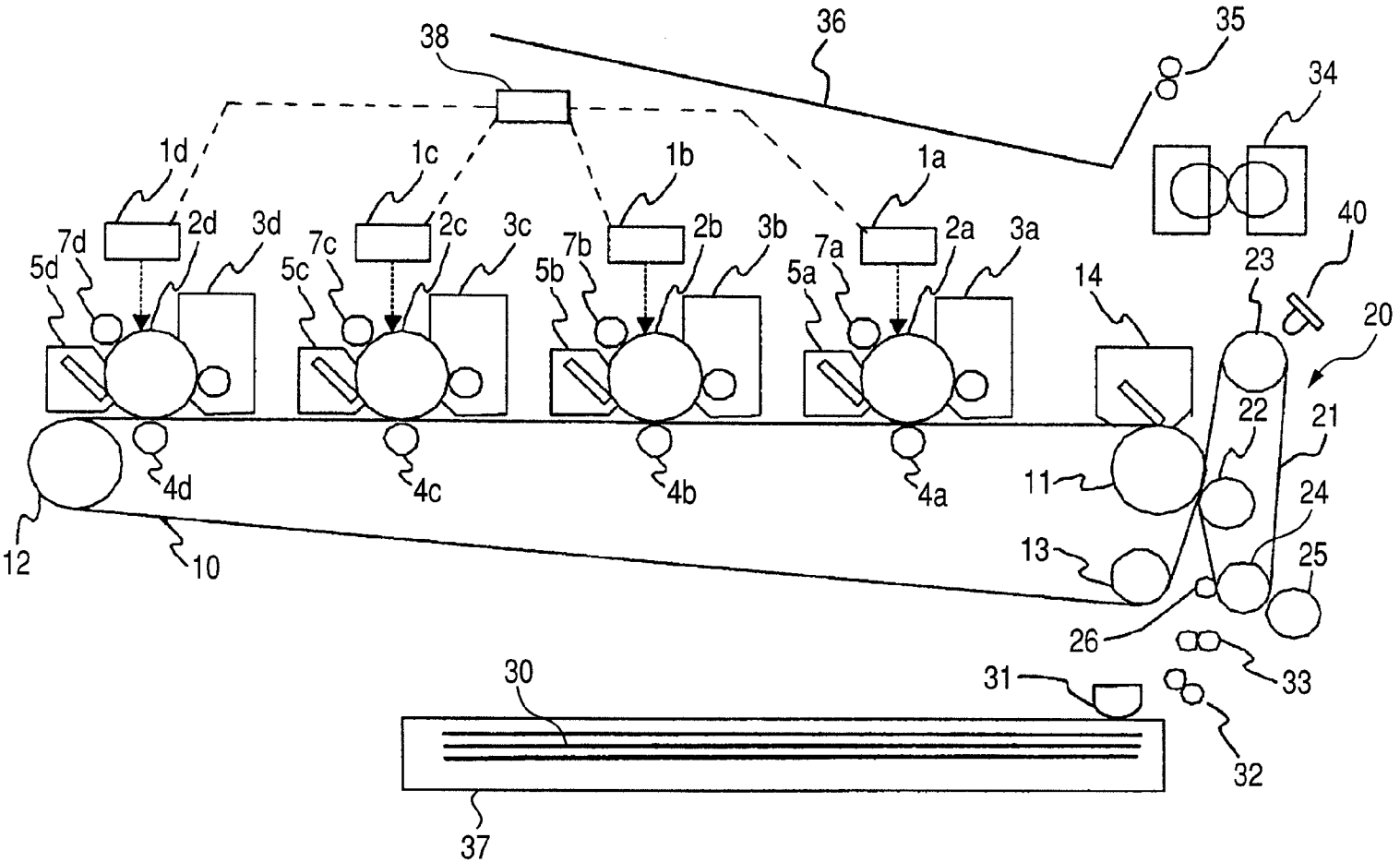
FIG. 1 is a diagram illustrating an image forming apparatus according to an embodiment of the present invention.
Figure 2:
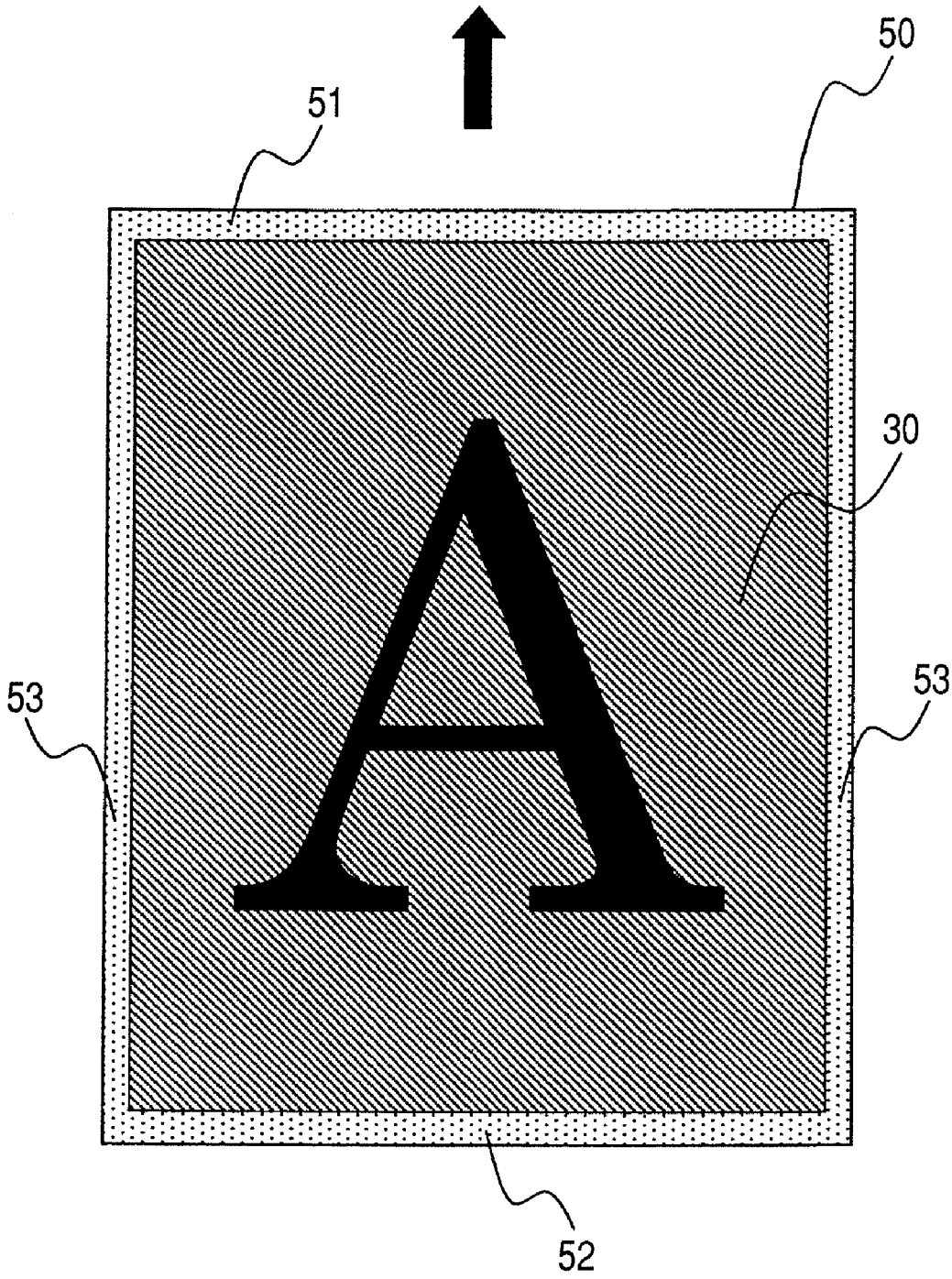
FIG. 2 is a diagram illustrating a relation between a size of a recording material and a size of a toner image in a marginless mode.
Figure 3:
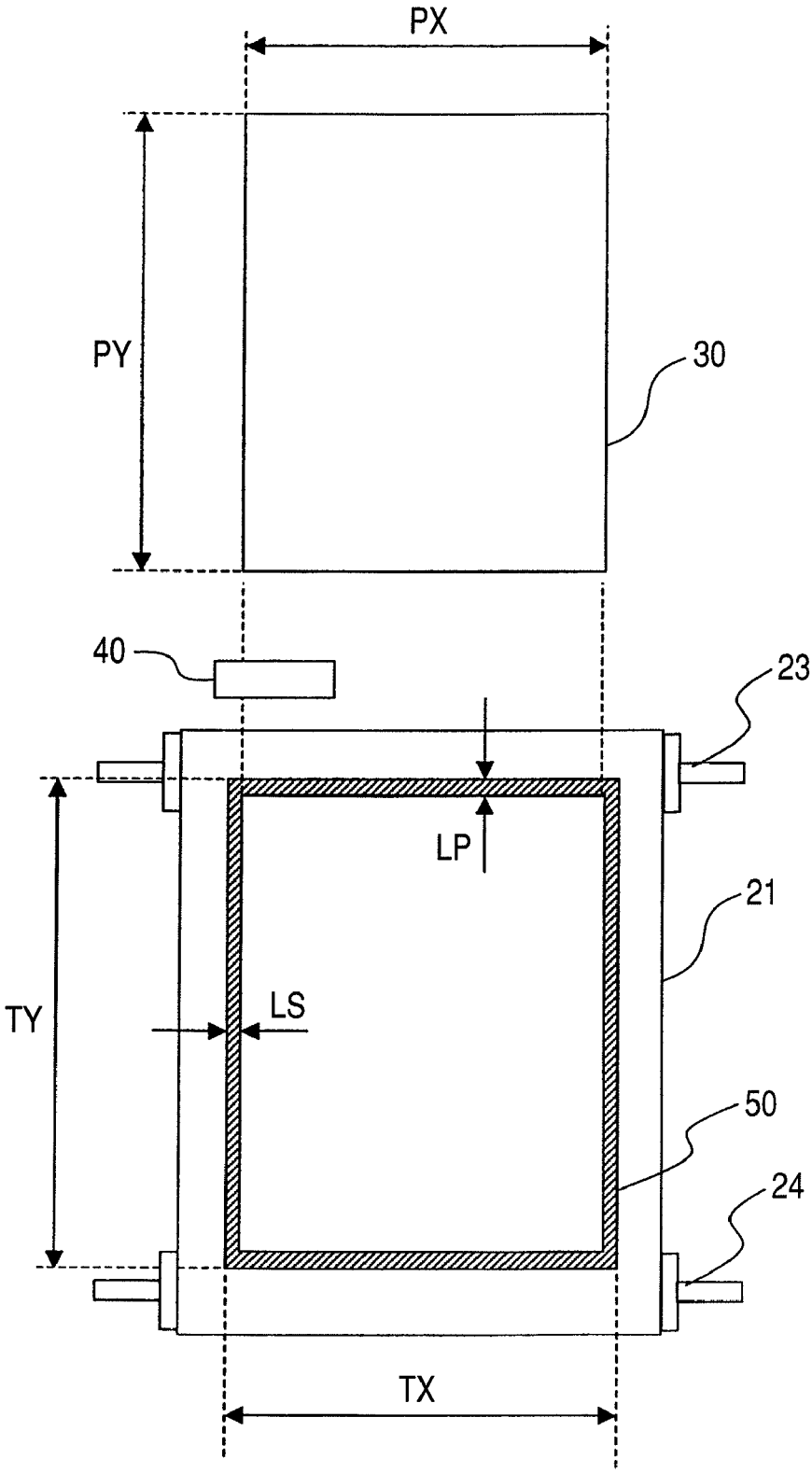
FIG. 3 is a diagram illustrating marginless recording on a maximum size recording material.
Figure 4:
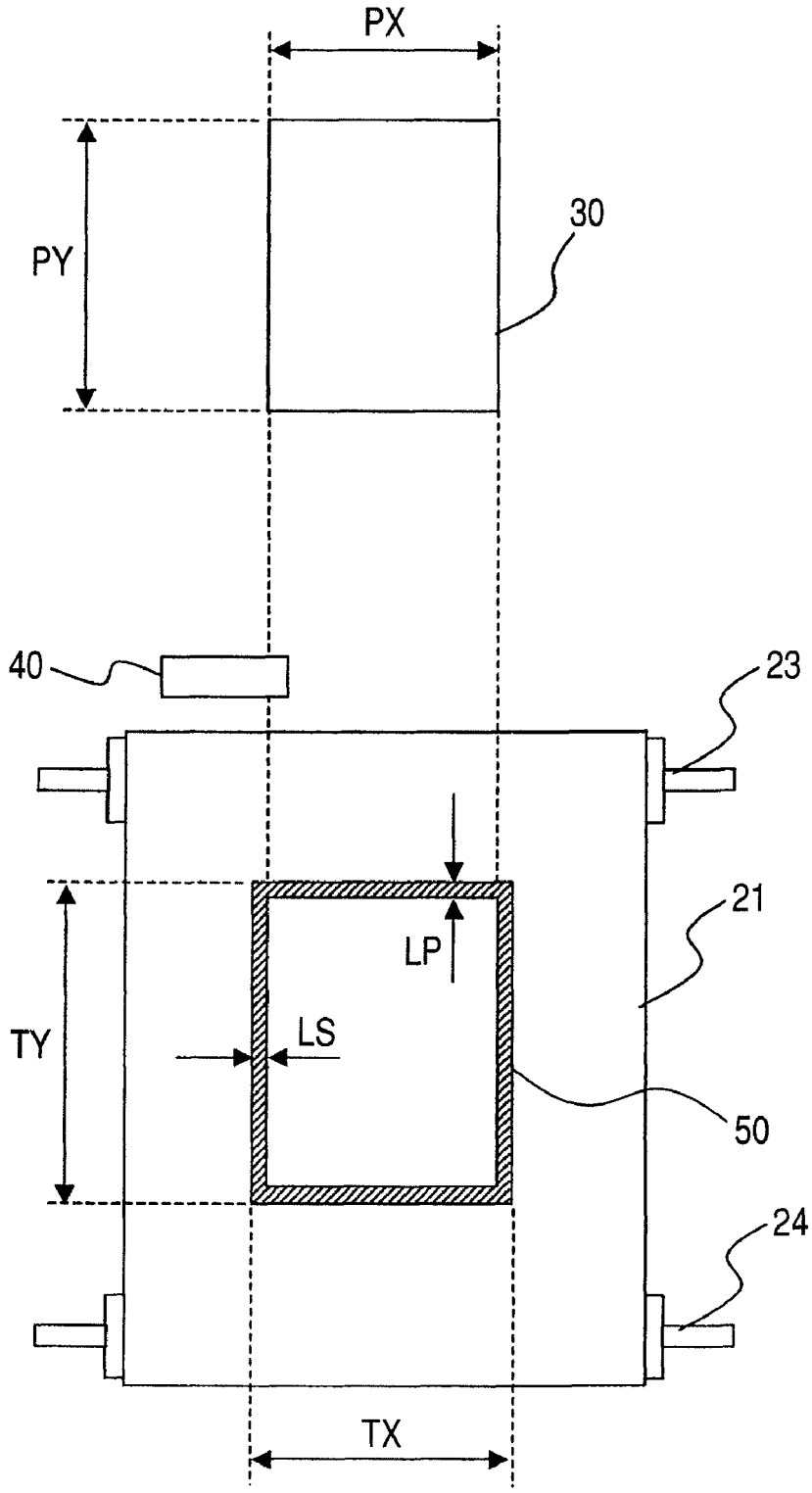
FIG. 4 is a diagram illustrating marginless recording on a minimum size recording material.
Figure 5:
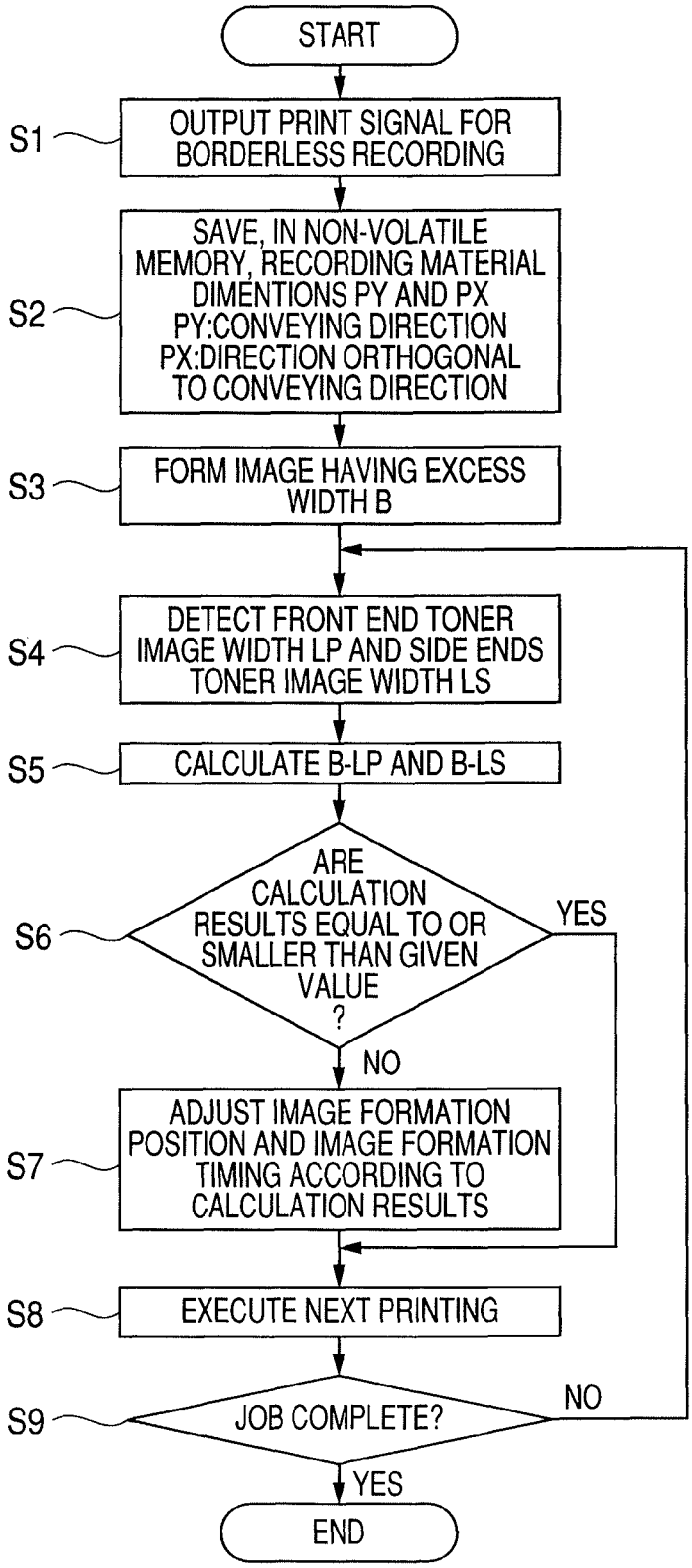
FIG. 5 is a flowchart for describing a flow of adjusting an image formation position with respect to a recording material in marginless recording.

An image forming apparatus according to a first embodiment of the present invention is described with reference to FIGS. 1, 2, 3, 4 and 5. FIG. 1 is a schematic sectional view illustrating the schematic structure of the image forming apparatus. FIG. 2 is a top view illustrating the relation between the size of a recording material and the size of a toner image in marginless recording. FIG. 3 is a top view illustrating marginless recording on a recording material of the maximum size that is supported by the image forming apparatus. FIG. 4 is a top view illustrating marginless recording on a recording material of the minimum size that is supported by the image forming apparatus. FIG. 5 is a flowchart for describing processing of adjusting the image formation position with respect to a recording material in marginless recording. An image forming apparatus according to a first embodiment of the present invention is described with reference to FIGS. 1, 2, 3, 4 and 5. FIG. 1 is a schematic sectional view illustrating the schematic structure of the image forming apparatus. FIG. 2 is a top view illustrating the relation between the size of a recording material and the size of a toner image in marginless recording. FIG. 3 is a top view illustrating marginless recording on a recording material of the maximum size that is supported by the image forming apparatus. FIG. 4 is a top view illustrating marginless recording on a recording material of the minimum size that is supported by the image forming apparatus. FIG. 5 is a flow chart for describing processing of adjusting the image formation position with respect to a recording material in marginless recording.

The following description first addresses the schematic structure of the image forming apparatus with reference to FIG. 1. Next described with reference to FIG. 2 is marginless recording in which an image is formed on a recording material without margins. Thereafter, how the image formation position is adjusted with respect to a recording material in marginless recording is described with reference to FIGS. 3, 4 and 5.

The image forming apparatus is provided with four electrophotographic photosensitive drums 2*a*, 2*b*, 2*c* and 2*d* (hereinafter, collectively referred to as "photosensitive drum(s) 2"), which serve as image bearing members for colors yellow, magenta, cyan and black and which are arranged side by side as illustrated in FIG. 1. Each of the photosensitive drums 2 is surrounded by process devices, which constitute an image forming section together with the photosensitive drum. The process devices are, from upstream to downstream in the rotation direction of the photosensitive drum, a primary charging unit 7*a*, 7*b*, 7*c* or 7*d* (hereinafter, collectively referred to as "primary charging unit(s) 7"), a developing device 3*a*, 3*b*, 3*c* or 3*d* (hereinafter, collectively referred to as "developing device(s) 3"), and a cleaning device 5*a*, 5*b*, 5*c* or 5*d* (hereinafter, collectively referred to as "cleaning device(s) 5"). There are four image forming sections in total; here, first, second, third and fourth image forming sections are denoted by reference symbols a, b, c and d, respectively.

The primary charging unit 7 is a charging device for charging the surface of the photosensitive drum 2 evenly. Charged uniformly by the primary charging unit 7, the surface of the photosensitive drum 2 is then irradiated with a laser beam by an exposure device 1*a*, 1*b*, 1*c* or 1*d* (hereinafter, collectively referred to as "exposure device(s) 1") based on image information, to thereby form an electrostatic latent image. The developing device 3 adheres a toner (developer) of one of the four colors to the surface of the photosensitive drum 2 where the electrostatic latent image has been formed, thus visualizing (developing) a toner image. The cleaning device 5 removes toner remaining on the surface of the photosensitive drum 2 after the transfer.

Across the photosensitive drums 2 arranged side by side, an intermediate transfer belt 10 is placed to serve as an intermediate transfer member to which toner images formed on the surfaces of the photosensitive drums 2 are transferred primarily. The intermediate transfer belt 10 is stretched around a drive roller 11, a tension roller 12, and a follower roller 13. The intermediate transfer belt 10 is provided with an intermediate transfer belt cleaner 14 for removing toner adhering to the intermediate transfer belt 10. The intermediate transfer belt cleaner 14 employs, for example, blade cleaning, which uses urethane rubber, or brush cleaning, which uses a conductive brush.

A secondary transfer section 20 is opposite from the drive roller 11 with the intermediate transfer belt 10 sandwiched in-between. The secondary transfer section 20 carries and conveys a recording material to transfer a toner image from the intermediate transfer belt 10 to the recording material. The secondary transfer section 20 has a secondary transfer belt (endless belt) 21 as a recording material carrying member, which carries and conveys a recording material. The secondary transfer belt 21 is stretched between a secondary transfer drive roller 23 and a secondary transfer tension roller 24. The secondary transfer section 20 also has a secondary transfer roller 22 placed to face the drive roller 11 as a secondary transfer device for transferring a toner image to a recording material. The secondary transfer tension roller 24 faces an attracting roller 26, which makes a recording material stick to the secondary transfer belt 21, and a secondary transfer cleaning roller 25, which is a cleaning member for temporarily collecting toner from the secondary transfer belt 21.

The attracting roller 26 and the secondary transfer cleaning roller 25 are positioned with respect to the axis of the secondary transfer tension roller 24, which is an opposing roller to the attracting roller 26 and the secondary transfer cleaning roller 25, and thus keep their distances from the secondary transfer tension belt 24 constant. The opposing roller does not need to be the secondary transfer tension roller 24 and another roller may be provided separately.

In order to convey a recording material by attracting the recording material to the secondary transfer belt 21, the attracting roller 26 is placed at a point that is opposite from the secondary transfer tension roller 24 and that is downstream of a wound portion in the moving direction of the secondary transfer belt 21. The wound portion is where the secondary transfer belt 21 is wound around the secondary transfer tension roller 24. An applied power for attracting bias (not shown), which is a constant voltage power source, is connected to the attracting roller 26. The attracting roller 26 is pressed against the secondary transfer tension roller 24 through the secondary transfer belt 21 by biasing metal core portions at the ends of the attracting roller 26 with springs, whereby the attracting roller 26 rotates following the movement of the transfer belt 21. This creates an attraction nipping portion between the attracting roller 26 and the secondary transfer tension roller 24.

The secondary transfer cleaning roller 25 is a cleaning member for removing toner adhering to the secondary transfer belt 21, and has many conductive threads rooted in a metal core. The secondary transfer cleaning roller 25 is placed at a point that is opposite from the secondary transfer tension roller 24 and that is upstream of the wound portion in the moving direction of the secondary transfer belt 21. The secondary transfer cleaning roller 25 receives a drive force transmitted from the secondary transfer tension roller 24 via a gear (not shown) to rotate in the same direction as the rotation direction of the secondary transfer belt 21. Accordingly, the secondary transfer cleaning roller 25 abuts the secondary transfer belt 21 in the counter direction while rotating. The rotation direction of the secondary transfer cleaning roller 25 may instead be the forward direction of the secondary transfer belt 21. Desirably, however, the rotation direction of the secondary transfer cleaning roller 25 is set to the counter direction because this way a physical scraping force can contribute to the toner collection by the secondary transfer cleaning roller 25. The secondary transfer cleaning roller 25, which is a conductive brush here, may instead be a urethane rubber blade. In that case, toner adhering to the secondary transfer belt 21 is removed by blade cleaning.

Toner images formed on the photosensitive drums 2 are transferred primarily to the intermediate transfer belt 10 by the action of the primary transfer devices 4*a*, 4*b*, 4*c* and 4*d*, which face the respective photosensitive drums 2 with the intermediate transfer belt 10 sandwiched in-between.

Sheets of a recording material 30 in a feed cassette 37 are pushed out by a pickup roller 31 to be fed one by one by a separating device (not shown). The recording material 30 is sent by a conveying roller pair 32 to a registration roller pair 33, which conveys the recording material 30 to a space between the attracting roller 26 and the secondary transfer belt 21 in a timed manner. The recording material 30 is thus conveyed by being stuck to the secondary transfer belt 21. The recording material 30 is conveyed to a space between the intermediate transfer belt 10 and the secondary transfer belt 21 while electrostatically attracted to the secondary transfer belt 21.

The toner images that have been transferred primarily to the intermediate transfer belt 10 are transferred secondarily to the recording material 30 by the action of the secondary transfer roller 22. After the secondary transfer, the residual toner images on the intermediate transfer belt 10 are removed by the belt cleaner 14. The toner images transferred to the recording material 30 are fixed by a fixing device 34. The recording material 30 is then conveyed by a delivery roller pair 35 and discharged onto a delivery tray 36, which is placed in an upper part of the apparatus main body.

The image forming apparatus has a first mode (normal recording mode) in which a toner image smaller than the recording material 30 is formed and transferred to the recording material 30 leaving margins on all four sides of the recording material 30. The image forming apparatus also has a second mode (marginless recording mode) in which a toner image larger than the recording material 30 is formed and transferred to extend all the way to the edges of the recording material 30. In the marginless recording mode, a toner image is formed on the photosensitive drum 2 in an area that covers the recording material 30 and an area that surrounds the recording material 30. The toner image is then transferred to the entire surface of the recording material 30 carried by the secondary transfer belt 21, including the edging portions of the recording material 30 which are normally left blank as margins. The image forming apparatus can thus perform normal recording, which leaves margins on all four sides of a recording material, and marginless recording, which leaves margins on none of the four sides of a recording material, with a single main body structure. Marginless recording here takes, as an example, recording in which margins are left on none of the four sides of a recording material, but is not limited thereto. Recording that does not leave a margin on at least one side of a recording material may be defined as marginless recording.

Marginless recording in which an image is formed without leaving margins on a recording material is described with reference to FIG. 2. In this marginless recording, a toner image 50 larger in size than the recording material 30 is formed on the photosensitive drum 2. This toner image 50 is transferred to the intermediate transfer belt 10 and then transferred to the recording material 30 by the secondary transfer roller 22, thereby completing marginless recording. In this process, part of the toner image 50 formed in the above-mentioned manner that extends beyond the edges of the recording material 30, namely, excess toner images 51, 52 and 53, are transferred to the secondary transfer belt 21.

Of these excess toner images, the toner image 51 is a front end toner image which extends beyond the front edge in the conveying direction of the recording material 30 (direction indicated by an arrow of FIG. 2). The toner image 52 is a rear end toner image which extends beyond the rear edge in the conveying direction of the recording material 30. The toner images 53 are side toner images which extend beyond both edges in the width direction of the recording material 30. The toner images 51, 52 and 53 which are transferred to the secondary transfer belt 21 outside of the recording material 30 are temporarily collected by the secondary transfer cleaning roller 25, and again transferred to the secondary transfer belt 21 after one recording material is processed and before the next recording material is processed. The toner images 51, 52, and 53 are thereafter transferred to the intermediate transfer belt 10 from the secondary transfer belt 21 by the secondary transfer section 20, and then removed from the intermediate transfer belt 10 by a cleaning blade within the intermediate transfer belt cleaner 14, to be collected in a toner collection box.

The recording material 30 which is stuck to the secondary transfer belt 21 during conveyance owing to the attraction roller 26 is conveyed stably to the secondary transfer section. This prevents such unstable behavior of the front end of the recording material 30 that causes the recording material 30 to scrape up toner on the secondary transfer belt 21, thereby smearing the front edge of the recording material 30 and blurring the recorded image. Further, since the amount of toner adhered to the recording material's front edge in the secondary transfer section is greatly reduced, there is less chance of smearing a guide during recording material conveyance to a fixing nip portion and adhering toner to a fixing member.

Described next with reference to FIGS. 3, 4 and 5 is how the image formation position is adjusted with respect to a recording material in the marginless recording mode.

A detecting device which detects the amount (width) of toner images that extend beyond the edges of the recording material 30 and are transferred to the secondary transfer belt 21 is described first with reference to FIGS. 3 and 4.

As illustrated in FIG. 1, the secondary transfer section 20 is provided with a detection sensor 40, which is opposed to the secondary transfer drive roller 23 with the secondary transfer belt 21 interposed therebetween. The detection sensor 40 serves as a detecting device which detects toner images transferred to the secondary transfer belt 21. The detection sensor 40 is capable of detecting the widths of the front end toner image 51 and side toner images 53 transferred to the secondary transfer belt 21 outside the edges of the recording material 30 as illustrated in FIGS. 3 and 4. In marginless recording, the detection sensor 40 detects toner images remaining on the secondary transfer belt 21 after the recording material 30 is removed from the secondary transfer belt 21.

The detection sensor 40 is positioned with respect to the secondary transfer drive roller 23 through a support member (not shown). Accordingly, the distance between the secondary transfer belt 21 and the detection sensor 40 is kept to a given value with precision. A shutter (not shown) for blocking the detection sensor 40 from the secondary transfer belt 21 may be provided in order to prevent a spray of toner from smearing a detecting portion of the detection sensor 40 and lowering the detection performance.

As illustrated in FIGS. 3 and 4, the detection range of the detection sensor 40 in the longitudinal direction of the secondary transfer drive roller 23 (direction orthogonal to the conveying direction of the secondary transfer belt 21) stretches from the outside of the edges of a marginless mode toner image formed on the recording material 30 of the maximum size that is supported by the image forming apparatus to the inside of the edges of the recording material 30 of the minimum size that is supported by the image forming apparatus. The longitudinal axial line of the detection sensor 40 is in the width direction, which is orthogonal to the conveying direction of the recording material 30. The detection sensor 40 can be placed on either one of the ends in the width direction of the recording material 30.

The operation of adjusting the image formation position in marginless recording on the recording material 30 is described next with reference to FIG. 5.

As illustrated in FIG. 5, when a print signal for marginless recording is output (Step S1), a dimension PY of the recording material 30 in the recording material conveying direction and a dimension PX of the recording material 30 in a direction orthogonal to the recording material conveying direction are saved in a non-volatile memory (Step S2). In Step S3, to print a first page, the toner image 50 larger in size than the recording material 30 by a given excess width B is formed on the photosensitive drum 2, and transferred to the intermediate transfer belt 10. This toner image 50 sized to be larger by the given excess width B and the recording material 30 satisfy a size relation TY>PY and TX>PX, where TY represents the dimension of the toner image 50 in the conveying direction and TX represents the dimension of the toner image 50 in the width direction orthogonal to the conveying direction.

In short, the recording material size, the toner image size, and the excess width have a relation expressed as TY=PY+(2×B) and TX=PX+(2×B).

After the toner image 50 is transferred to the recording material 30, the detection sensor 40 detects a width LP of the front end toner image 51 and a width LS of the side toner images 53 (Step S4). The toner image widths LP and LS are the excess widths of toner images that extend beyond the edges of the recording material 30 and transferred to the secondary transfer belt 21. The differences (B−LP and B−LS) between the toner image excess widths LP and LS detected by the detection sensor 40 and the given excess width B, which is set in advance, are calculated (Step S5). Whether or not the calculation results are equal to or smaller than a given value is determined (Step S6). When it is determined in Step S6 that the calculation results are equal to or smaller than the given value, the processing proceeds to Step S8, where the operation of printing a second page is executed without adjusting the position of latent image formation on the photosensitive drum 2 by the exposure device 1. When the calculation results are determined to be larger than the given value in Step S6, it is determined that the image formation position has deviated from the correct position by the calculated differences, and the image formation position is adjusted in Step S7 such that the calculated differences are equal to or smaller than the given value.

In Step S7, a control device 38 adjusts the position of latent image formation on the photosensitive drum 2 by the exposure device 1 by the calculated differences, namely, the amount of deviation. Specifically, the timing in which to draw a latent image on the photosensitive drum 2 with the exposure device 1 is adjusted based on the difference (deviation amount) between the excess width LP extending beyond the edge (front end) of the recording material 30 in the conveying direction and the given excess width B. This drawing timing is in terms of the rotation direction of the photosensitive drum 2, which corresponds to the recording material conveying direction. The position of drawing a latent image on the photosensitive drum 2 with the exposure device 1 is also adjusted based on the difference (deviation amount) between the excess width LS extending beyond the edges (side ends) of the recording material 30 in the width direction thereof and the given excess width B. This drawing position is in terms of the longitudinal direction (axial direction) of the photosensitive drum 2, which corresponds to the recording material width direction. In this way, the image formation position of a toner image transferred to a recording material is adjusted in the conveying direction and in the direction orthogonal to the conveying direction, and the image formation position on the second-page recording material can be adjusted with precision. In the case where the next page is to be subsequently printed in Step S8, the processing returns from Step S9 to Step S4 to continue the above-mentioned series of operations for the second and subsequent pages. An image can thus always be formed at a correct position on a recording material, and the precision of the image formation position with respect to a recording material is improved.

In portions of the toner image 50 that extend beyond the edges of a recording material, namely, the front end toner image 51 and the side toner images 53, the excess widths LP and LS desirably have a density high enough and an area large enough to be detected by the detection sensor 40.

When the image formation position deviates from the correct position in marginless recording, the second transfer cleaning roller 25 collects more toner on one side in the width direction than on the other side, which can cause a cleaning error. In the case where blade cleaning is employed instead of cleaning by the second transfer cleaning roller 25, the deviation causes not only a cleaning error but also an uneven accumulation of waste toner (toner removed from the secondary transfer belt 21) in a waste toner container. The toner could leak as a result. Ensuring that the image formation position is accurate in marginless recording therefore leads to the prevention of the cleaning error and leakage of waste toner as well.

In addition, when the image forming position is kept accurate in marginless recording, the excess width B set to, for example, 2 mm can be reduced further and the total amount of waste toner can be reduced accordingly. As a result, the lifetime of the waste toner container is prolonged and the image forming apparatus consumes less toner.

While the structure illustrated here as an example conveys the recording material 30 to the secondary transfer section after making the recording material 30 stuck to the secondary transfer belt 21 with the attracting roller 22, the attracting roller 22 may be omitted as long as an image on the intermediate transfer belt 10 is not disturbed by the entrance of the recording material 30. For example, the attracting roller 22 can be omitted by setting an angle at which the recording material 30 conveyed from the registration roller pair 33 comes into contact with the intermediate transfer belt 10 small, or by guiding the recording material 30 along the secondary transfer belt 21 when the recording material enters the secondary transfer section.

The exposure device given here as an example is a laser scanner which emits a laser beam. However, the present invention is not limited thereto and other exposure devices, for example, an LED or a liquid crystal shutter may be employed instead.

Second Embodiment

An image forming apparatus according to a second embodiment of the present invention is described with reference to FIG. 6. The overall schematic structure of this image forming apparatus is the same as in the above-mentioned embodiment, and the description is not repeated here. Also, functions and structures of the second embodiment that are equivalent to those of the first embodiment are denoted by the same reference symbols to avoid repetitive description.

Described first is a detecting device for detecting toner images that are transferred to the secondary transfer belt 21 as a result of extending beyond the recording material 30.

Figure 6:
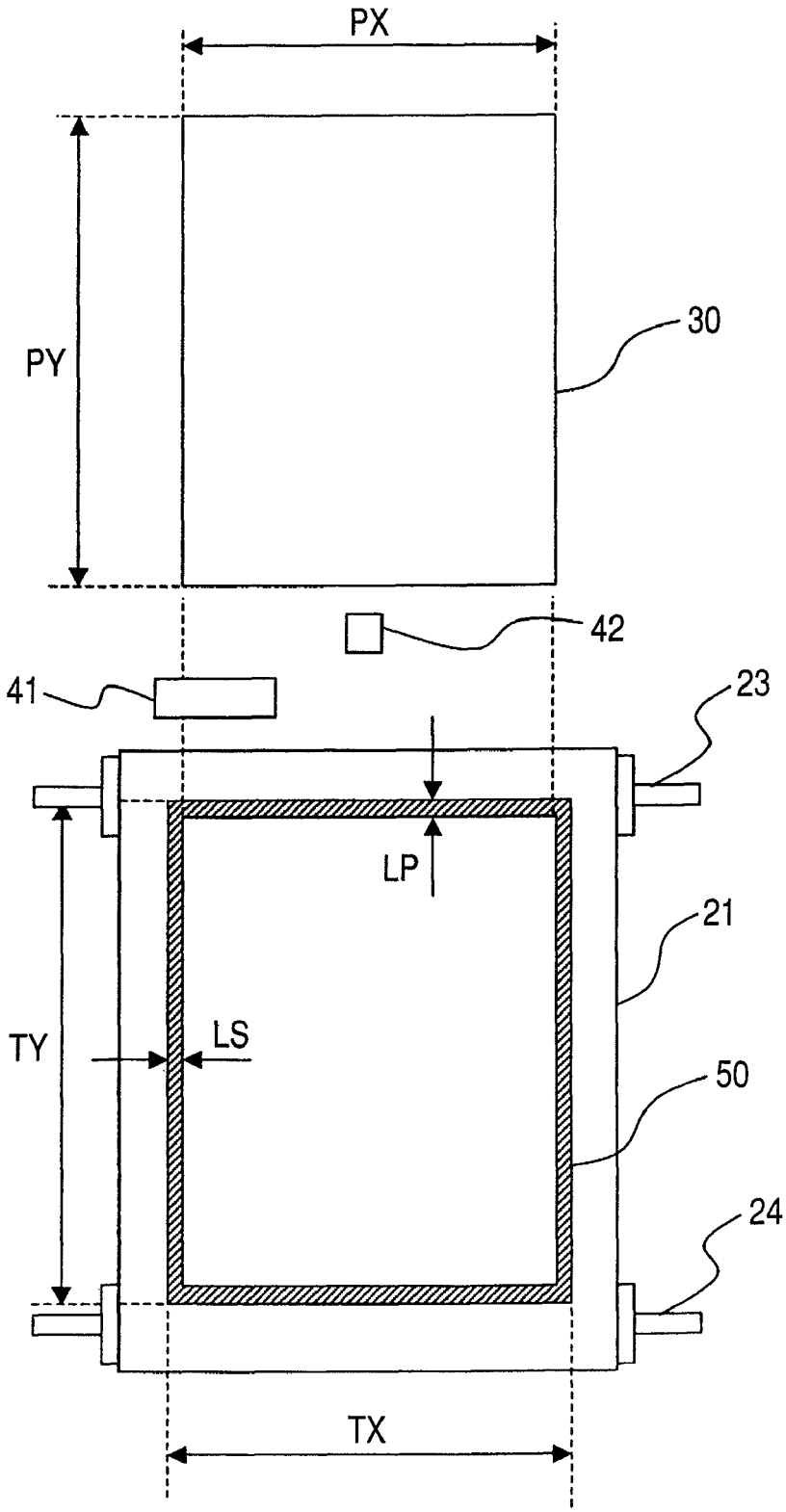
FIG. 6 is a diagram illustrating a structure for detecting an excess width of a toner image with two detection sensors.

As illustrated in FIG. 6, the secondary transfer section 20 is provided with a first detection sensor 41 and a second detection sensor 42, which are opposed to the secondary transfer drive roller 23 with the secondary transfer belt 21 interposed therebetween. The first detection sensor 41 and the second detection sensor 42 are detecting devices which detect toner images transferred to the secondary transfer belt 21. The first detection sensor 41 is a first detecting device capable of detecting the widths of the side toner images 53 extending beyond the edges in the width direction of the recording material 30 and transferred to the secondary transfer belt 21. The second detection sensor 42 is a second detecting device capable of detecting the width of the front end toner image 51 extending beyond the edge in the conveying direction of the recording material 30 and transferred to the second transfer belt 21.

The first detection sensor 41 and the second detection sensor 42 are positioned with respect to the secondary transfer drive roller 23 through a support member (not shown). Accordingly, the distance between the secondary transfer belt 21 and the first detection sensor 41 and the distance between the secondary transfer belt 21 and the second detection sensor 42 are kept to given values with precision. A shutter (not shown) for blocking the first detection sensor 41 and the second detection sensor 42 from the secondary transfer belt 21 may be provided in order to prevent a spray of toner from smearing detecting portions of the first detection sensor 41 and the second detection sensor 42 and lowering the detection performance.

As illustrated in FIG. 6, the detection range of the first detection sensor 41 in the longitudinal direction of the secondary transfer drive roller 23 stretches from the outside of the edges of a marginless mode toner image formed on the recording material 30 of the maximum size that is supported by the image forming apparatus to the inside of the edges of the recording material 30 of the minimum size that is supported by the image forming apparatus. The longitudinal axial line of the first detection sensor 41 is in the width direction, which is orthogonal to the conveying direction of the recording material 30. The first detection sensor 41 can be placed on any of the ends in the width direction of the recording material 30. The second detection sensor 42, on the other hand, can be placed at any point within a conveyance area through which the recording material 30 of every size passes.

Next, with reference to FIG. 5, the operation of adjusting the image formation position in marginless recording on the recording material 30 is described.

As illustrated in FIG. 5, when a print signal for marginless recording is output (Step S1), a dimension PY of the recording material 30 in the recording material conveying direction and a dimension PX of the recording material 30 in a direction orthogonal to the recording material conveying direction are saved in a non-volatile memory (Step S2). To print a first page, the toner image 50 larger in size than the recording material 30 by a given excess width B is formed on the photosensitive drum 2, and transferred to the intermediate transfer belt 10 (Step S3). This toner image 50 sized to be larger by the given excess width B and the recording material 30 satisfy a size relation TY>PY and TX>PX, where TY represents the dimension of the toner image 50 in the conveying direction and TX represents the dimension of the toner image 50 in the width direction orthogonal to the conveying direction. In short, the recording material size, the toner image size, and the excess width have a relation expressed as $TY=PY+(2\times B)$ and $TX=PX+(2\times B)$.

After the toner image 50 is transferred to the recording material 30, the second detection sensor 42 detects a width LP of the front end toner image 51 and the first detection sensor 41 detects a width LS of the side toner images 53 in Step S4. The toner image widths LP and LS are the excess widths of toner images that extend beyond the edges of the recording material 30 and transferred to the secondary transfer belt 21. The differences (B−LP and B−LS) between the toner image excess widths LP and LS detected by the detection sensors 41 and 42 and the given excess width B, which is set in advance, are calculated (Step S5). Whether or not the calculation results are equal to or smaller than a given value is determined (Step S6). When it is determined in Step S6 that the calculation results are equal to or smaller than the given value, the processing proceeds to Step S8, where the operation of printing a second page is executed without adjusting the position of latent image formation on the photosensitive drum 2 by the exposure device 1. When the calculation results are determined to be larger than the given value in Step S6, it is determined that the image formation position has deviated from the correct position by the calculated differences, and the image formation position is adjusted in Step S7 such that the calculated differences are equal to or smaller than the given value.

The control device 38 adjusts the position of latent image formation on the photosensitive drum 2 by the exposure device 1 by the calculated differences, namely, the amount of deviation (Step S7). Specifically, the timing in which to draw a latent image on the photosensitive drum 2 with the exposure device 1 is adjusted based on the difference (deviation amount) between the excess width LP extending beyond the edge (front end) of the recording material 30 in the conveying direction and the given excess width B. This drawing timing is in terms of the rotation direction of the photosensitive drum 2, which corresponds to the recording material conveying direction. The position of drawing a latent image on the photosensitive drum 2 with the exposure device 1 is also adjusted based on the difference (deviation amount) between the excess width LS extending beyond the edges (side ends) of the recording material 30 in the width direction thereof and the given excess width B. This drawing position is in terms of the longitudinal direction (axial direction) of the photosensitive drum 2, which corresponds to the recording material width direction. In this way, the image formation position of a toner image transferred to a recording material is adjusted in the conveying direction and in the direction orthogonal to the conveying direction, and the image formation position on the second-page recording material can be adjusted with precision. In the case where the next page is to be subsequently printed in Step S8, the processing returns from Step S9 to Step S4 to continue the above-mentioned series of operations for the second and subsequent pages. An image can thus always be formed at a correct position on a recording material, and the precision of the image formation position with respect to a recording material is improved.

In portions of the toner image 50 that extend beyond the edges of a recording material, namely, the front end toner image 51 and the side toner images 53, the excess widths LP and LS desirably have a density high enough and an area large enough to be detected by the detection sensors 41 and 42.

Third Embodiment

Figure 7:
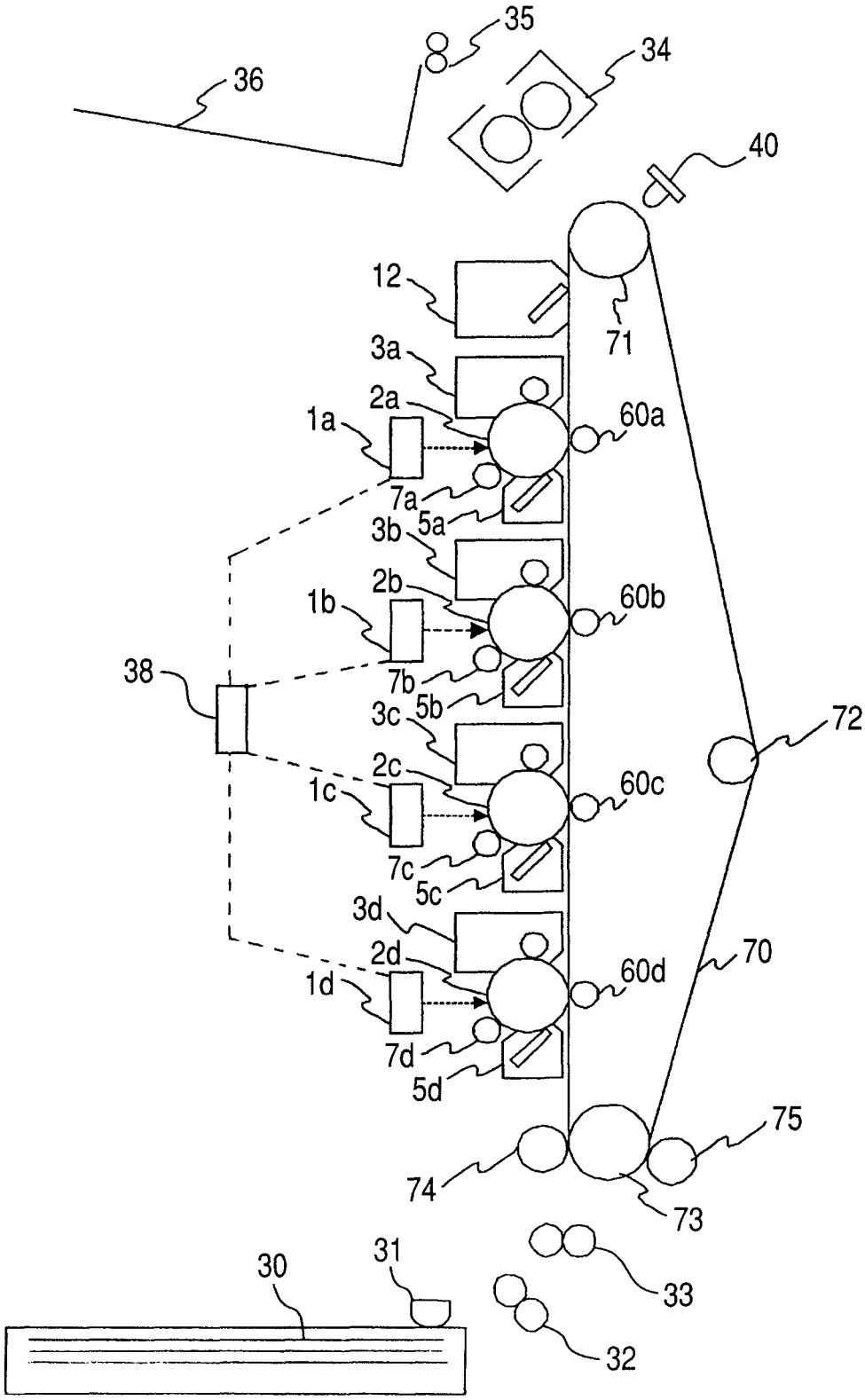
FIG. 7 is a diagram illustrating an image forming apparatus according to another embodiment of the present invention.

With reference to FIG. 7, an image forming apparatus according to a third embodiment of the present invention is described. In the third embodiment, the structure of a detecting device that detects an excess width of a toner image on an endless belt and the operation of adjusting the image formation position in marginless recording with the use of this detecting device are the same as in the above-mentioned embodiments, and the description thereof is not repeated here. Also, functions and structures of the third embodiment that are equivalent to those of the above-mentioned embodiments are denoted by the same reference symbols to avoid repetitive description.

The image forming apparatus given here as an example employs a method in which toner images of four colors formed on the respective photosensitive drums 2 are transferred directly to the recording material 30 that is attracted to and conveyed on a transfer/conveyor belt 70 as illustrated in FIG. 7. The transfer/conveyor belt 70 is an endless belt that carries and conveys a recording material, and is stretched around a drive roller 71, a tension roller 72, and a follower roller 73. The follower roller 73 faces an attracting roller 74, which makes the recording material 30 stick to the transfer/conveyor belt 70, and a conductive brush roller 75, which is a cleaning member for temporarily collecting toner from the transfer/conveyor belt 70. The drive roller 71 is opposed to the detection sensor 40 as a detecting device which detects excess widths of toner images transferred to the transfer/conveyor belt 70 as a result of extending beyond the edges of the recording material 30.

Sheets of the recording material 30 in a feed cassette are pushed out by the pickup roller 31 to be fed one by one by a separating device (not shown). The recording material 30 is sent by the conveying roller pair 32 to the registration roller pair 33, which conveys the recording material 30 to a space between the attracting roller 74 and the transfer/conveyor belt 70 in a timed manner. The recording material 30 is thus conveyed by being stuck to the transfer/conveyor belt 70. Toner images formed on the photosensitive drums 2 are sequentially transferred to the recording material 30 in an overlapping manner by the action of transfer rollers 60*a*, 60*b*, 60*c* and 60*d*, which face the respective photosensitive drums 2 as transferring devices. Here, the transfer rollers 60*d*, 60*c*, 60*b* and 60*a* are first, second, third and fourth image forming sections, respectively. The toner images transferred to the recording material 30 are fixed by the fixing device 34. The recording material 30 is then conveyed by the delivery roller pair 35 and discharged onto the delivery tray 36, which is placed in an upper part of the apparatus main body.

The image forming apparatus has a first mode (normal recording mode) in which a toner image smaller than the recording material 30 is formed and transferred to the recording material 30 leaving margins on all four sides of the recording material 30. The image forming apparatus also has a second mode (marginless recording mode) in which a toner image larger than the recording material 30 is formed and transferred to extend all the way to the edges of the recording material 30. The image forming apparatus can thus perform normal recording, which leaves margins on all four sides of a recording material, and marginless recording, which leaves margins on none of the four sides of a recording material, with a single main body structure. Marginless recording here takes, as an example, recording in which margins are left on none of the four sides of a recording material, but is not limited thereto. Recording that does not leave a margin on at least any one of sides of a recording material is defined as marginless recording.

In marginless recording, the toner image 50 larger in size than the recording material 30 is formed on the photosensitive drum 2 as illustrated in FIG. 2. Portions of the toner image 50 that extend beyond the recording material 30, namely, the excess toner images 51, 52, and 53 are transferred to the transfer/conveyor belt 70.

The excess toner images 51, 52, and 53 are temporarily collected by the conductive brush roller 75, and again transferred to the transfer/conveyor belt 70 after one recording material is processed and before the next recording material is processed. The toner images 51, 52 and 53 are thereafter transferred to the photosensitive drum 2 from the transfer/conveyor belt 70 by the transfer section, and then removed by the cleaning device 5 of the photosensitive drum 2 to be collected in a cartridge container.

The transfer from the transfer/conveyor belt 70 to the photosensitive drum 2 is accomplished, in the first and third image forming sections, by applying bias of a polarity opposite to the one that is used in recording to the transfer rollers 60*b* and 60*d* and, in the second and fourth image forming sections, by applying bias of the same polarity as the one that is used in recording to the transfer rollers 60*a* and 60*c*. In this way, toner of both polarities can be collected and, by setting the rotation rate of the photosensitive drum 2 higher than that of the transfer/conveyor belt 70 by a given amount, the toner collection performance is improved, which shortens the cleaning time.

The detecting device illustrated here as an example is the detection sensor 40 described in the first embodiment, but may instead be the first detection sensor 41 and the second detection sensor 42 which have been described in the second embodiment.

A conductive brush roller is taken here as an example of the cleaning member of the transfer/conveyor belt 70. However, the present invention is not limited thereto and, for example, a cleaning blade made of urethane rubber may be employed.

The precision of the image formation position with respect to a recording material can thus be improved in an image forming apparatus of a method that transfers a toner image directly from a photosensitive drum onto a recording material as well by adjusting the latent image formation position on a photosensitive drum in the manner described in the above-mentioned embodiments.

As has been described, according to the present invention, the position of a recording material in relation to a toner image can be detected directly. Adjusting the latent image formation position on an image bearing member based on the detection result improves the precision of the image formation position with respect to a recording material.

This concludes a description on embodiments of the present invention. However, the present invention is in no way limited to the above-mentioned embodiments, and is receptive of any modifications within the technical concept of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-305632, filed Nov. 27, 2007, which is hereby incorporated by reference herein in its entirety.

What is claimed is:

1. An image forming apparatus, comprising:

an image bearing member;

an exposure device which exposes said image bearing member to light to form a latent image on said image bearing member, wherein said image bearing member is configured to bear a toner image formed by developing the latent image with a toner;

a recording material carrying member which carries and conveys a recording material;

an intermediate transfer member to which the toner image is primary transferred from said image bearing member; and a transfer device which secondary transfers the toner image from said intermediate transfer member to the recording material carried by said recording material carrying member, wherein the image forming apparatus is configured with a marginless mode in which the toner image is formed on said image bearing member in an area that covers the recording material and an area outside the recording material, and the toner image is transferred to extend beyond an edge of the recording material carried by said recording material carrying member, the image forming apparatus further comprising:

a detecting device which detects a width of the toner image that extends beyond the edge of the recording material and is transferred from said intermediate transfer member to said recording material carrying member by said transfer device when the marginless mode is executed, and said detecting device is positioned opposite to said recording material carrying member; and a control device configured to use a detection result provided by said detecting device to control where said exposure device forms a latent image on said image bearing member.

2. An image forming apparatus according to claim 1, wherein, the detecting device is opposite to the recording material carrying member at a position at which the toner image arrives after the recording material is removed from said recording material carrying member.

3. An image forming apparatus according to claim 1, wherein, in the marginless mode, said control device controls said exposure device so that a difference between a width of the toner image, that extends beyond the edge of the recording material and is transferred from the intermediate transfer member to said recording material carrying member by the transfer device, and a preset excess width is equal to or smaller than a given value.

4. An image forming apparatus according to claim 1, wherein said detecting device detects an excess width extending beyond an edge of the recording material in a recording material conveying direction and an excess width extending beyond an edge of the recording material in a direction orthogonal to the recording material conveying direction.

5. An image forming apparatus according to claim 1, wherein a detection range of said detecting device in a direction orthogonal to a recording material conveying direction stretches from an outside of edges of a marginless mode toner image formed on the recording material of a maximum size that is supported by the image forming apparatus to an inside of edges of the recording material of a minimum size that is supported by the image forming apparatus.

6. An image forming apparatus according to claim 1, wherein said detecting device comprises a first detecting device, which detects an excess width extending beyond an edge of the recording material in a direction orthogonal to a recording material conveying direction, and a second detecting device, which detects an excess width extending beyond an edge of the recording material in the recording material conveying direction.

7. An image forming apparatus, comprising:

an image bearing member;

an exposure device which exposes said image bearing member to light to form a latent image on said image bearing member, wherein said image bearing member is configured to bear a toner image formed by developing the latent image with a toner;

a recording material carrying member which carries and conveys a recording material; and a transfer device which transfers the toner image from said image bearing member to the recording material carried by said recording material carrying member, wherein the image forming apparatus is configured with a marginless mode in which the toner image is formed on said image bearing member in an area that covers the recording material and an area outside the recording material, and the toner image is transferred to extend beyond an edge of the recording material carried by said recording material carrying member, the image forming apparatus further comprising:

a detecting device which detects a width of the toner image that extends beyond the edge of the recording material and is transferred from said image bearing member to said recording material carrying member by said transfer device when the marginless mode is executed, and said detecting device is positioned opposite to said recording material carrying member; and a control device configured to use a detection result provided by said detecting device to control where said exposure device forms a latent image on said image bearing member.

* * * * *